United States Patent [19]

Khudosovtsev et al.

[11] Patent Number: 4,515,156

[45] Date of Patent: May 7, 1985

[54] REGENERATIVE CANISTER OF A SELF-CONTAINED OXYGEN-BREATHING APPARATUS ON CHEMICALLY FIXED OXYGEN

[75] Inventors: Nikolai M. Khudosovtsev; Jury A. Shevchenko; Anatoly I. Artemenko; Mikhail G. Danilevsky; Vladimir K. Kocherga; Viktor N. Luchko; Anatoly E. Margolis; Vladimir K. Ovcharov; Ljudmila Y. Filimonovna; Grigory A. Shulman, all of Donetsk, U.S.S.R.

[73] Assignee: Vsesojuzny Nauchno-Issledovatelsky Institut Gornospasatelngo Dela, Donetsk, U.S.S.R.

[21] Appl. No.: 508,556

[22] Filed: Jun. 28, 1983

[30] Foreign Application Priority Data

Jan. 17, 1983 [SU] U.S.S.R. ..... 3530204
Mar. 14, 1983 [SU] U.S.S.R. ..... 3558351

[51] Int. Cl.[3] ..... A62B 7/08
[52] U.S. Cl. ..... 128/202.26; 422/122
[58] Field of Search ..... 128/202.26, 205.12, 128/204.15; 55/DIG. 33, DIG. 35; 422/122

[56] References Cited

U.S. PATENT DOCUMENTS

| | | | |
|---|---|---|---|
| 1,983,475 | 12/1934 | Lemoine | 128/202.26 |
| 3,403,981 | 10/1968 | Lemcke et al. | 128/202.26 |
| 3,650,269 | 3/1972 | Curtis | 128/202.26 |
| 4,213,453 | 7/1980 | Warncke et al. | 128/202.26 |
| 4,277,443 | 7/1981 | Van der Smissen et al. | 128/202.26 |

FOREIGN PATENT DOCUMENTS

| | | | |
|---|---|---|---|
| 2519045 | 5/1976 | Fed. Rep. of Germany | 128/202.26 |
| 2852240 | 6/1980 | Fed. Rep. of Germany . | |
| 2035808 | 6/1980 | United Kingdom . | |
| 248504 | 7/1969 | U.S.S.R. . | |

*Primary Examiner*—Henry J. Recla
*Attorney, Agent, or Firm*—Fleit, Jacobson, Cohn & Price

[57] ABSTRACT

A regenerative canister of a self-contained oxygen-breathing apparatus, comprising a shell filled with an oxygen-delivering chemical, wherein heat-distributing elements are accommodated. A number of transverse air-permeable partitions are installed in the shell central portion to subdivide the shell interior into two compartments and to form a distributing chamber. Each of the compartments is provided with additional partitions that divide the oxygen-delivering chemical into at least two layers, while the heat-distributing elements are located on the section running from the distributing chamber to the layer of the oxygen-delivering chemical adjacent to the shell end.

8 Claims, 3 Drawing Figures

REGENERATIVE CANISTER OF A SELF-CONTAINED OXYGEN-BREATHING APPARATUS ON CHEMICALLY FIXED OXYGEN

This invention relates to the components of self-contained oxygen-breathing apparatus on chemically fixed oxygen, adapted for protection of man's respiratory organs. The invention is most expedient to be applied in breathing apparatus made use of in coal industry for rescue jobs during underground emergencies involving formation of irrespirable atmosphere, e.g., in case of fires or sudden outbursts of coal or methane. The invention is also applicable in breathing apparatus used for short-time protection of man's respiratory organs under adverse conditions in chemical and some other industries.

Known in the present state of the art is a mine-type self-contained oxygen-breathing self-rescue apparatus (also called self-rescuer) as described in USSR Inventor's Certificate No. 248,504, cl.A62B 7/08, 1968. The apparatus incorporates a regenerative canister filled with an oxygen-delivering chemical situated between perforated screens of which the bottom screen is spring-loaded.

The top chamber of the canister accommodates an air filter and a starting device. A corrugated hose with a mouthpiece is attached to the top cover of the canister through connection sleeves.

A disadvantage inherent in this cartridge resides in a considerable resistance to breathing offered by the bed of an oxygen-delivering chemical and rendering a negative physiological effect upon man.

In another self-contained breathing apparatus known (cf. British Pat. No. 2,035,808, cl.A5T, 1980) the regenerative canister comprises a casing with the inhalation and exhalation tubes, the starting device located on the cover of the canister, the filter situated before the inhalation connection, and a shell accommodated in the casing and filled with an oxygen-delivering chemical, which is subdivided by partitions rigidly fixed in position inside said shell, into a number of layers, each of said layers accommodating heat distributors, a number of crescent-shaped passages are provided in between the casing and the shell to connect the top chamber defined by the top end partition of the shell and the cover of the casing, to the bottom chamber established by the bottom end partition of the shell and the bottom end-plate of the casing.

This breathing apparatus suffers from the following disadvantages:

lack of operating reliability due to a possibility of "ingress" of $CO_2$ from the exhaled air into the breathing bag along the horizontal spaces formed between the oxygen-delivering chemical and the cartridge wall in the top portion of the compartments due to effect of vibration and jolting of the mine equipment (locomotives, coal-winning and heading machines) on which the apparatus is put by a miner;

increased respiratory resistance due to the oxygen-delivering chemical becoming disintegrated on account of its pellets rubbing against one another under the action of vibration;

reduced protection period due to the fact that the apparatus gets unfit for use on account of a maximum permissible $CO_2$ concentration in the breathing bag owing to its "ingress" into the latter, though the oxygen-delivering chemical still contains some amount of unspent oxygen.

It is a primary and essential object of the present invention to provide higher operating reliability of the regenerative canister due to its increased mechanical strength with respect to vibration loads.

It is another object of the present invention to provide a longer protecting time of the self-containing breathing apparatus making use of the regenerative canister charged with an oxygen-delivering chemical.

It is one more object of the present invention to provide a regenerative canister, wherein no substantial increase in the respiratory resistance would occur at the end of the service life thereof.

It is still more object of the present invention to provide practically uniform evolution of oxygen throughout the entire service life of the regenerative canister.

The essence of the invention resides in the fact that in the regenerative canister of a self-contained oxygen-breathing apparatus on chemically fixed oxygen, comprising an outer casing with inhalation and exhalation tubes, and an inner shell communicating with the exhalation tube and filled with an oxygen-delivering chemical inside which heat-distributing elements made of a heat-conducting material are located, while the inner shell has air-permeable ends and is so fastened on the outer casing that collector spaces are established between the ends of the inner shell and of the outer casing, said spaces communicating with each other and with the inhalation tube, wherein a filter is provided, whereas located on the outer casing is a starting device adapted for initiating the oxygen evolution by the oxygen-delivering chemical, according to the invention, air-permeable transverse partitions are positioned substantially in the central portion of the inner shell so as to subdivide the interior of the inner shell into two compartments and to stablish a distributing chamber which communicates with the starting device and the exhalation tube in order to direct the exhaled air from the distributing chamber to the inner shell ends through the bulk of the oxygen-delivering chemical, each of the inner shell compartments being provided with at least two additional transverse partitions to define a mixing chamber and to divide the oxygen-delivering chemical into at least two layers as along the direction of air flow from the distributing chamber to the inner shell ends, while the heat-distributing elements are located in the oxygen-delivering chemical on its section running from the distributing chamber to the layer of the oxygen-delivering chemical adjacent to the end of the inner shell.

Such a constructional arrangement of the regenerative canister:

provides for reliable operation of the breathing apparatus since it prevents formation of spaces between the inner shell walls and the layers of the oxygen-delivering chemical even under adverse conditions of vibration and jolting while in transit, improves respiratory conditions, prolongs the protection time.

It is preferable that in the regenerative canister said at least two additional partitions in each compartment of the inner shell be secured close to its air-permeable end in such a manner that the layer of the oxygen-delivering chemical adjacent to said end should have a thickness substantially equal to within 0.1 and 0.3 of the thickness of the oxygen-containing matter on the section spread from the distributing chamber to the layer of the oxygen-delivering chemical adjacent to the end of the inner shell.

Such an embodiment of the regenerative canister provides for an adequately low respiratory resistance (40 to 66 mm $H_20$).

It is desirable that in the regenerative cartridge whose inner shell is filled with an oxygen-delivering chemical in the form of pellets sized substantially from 2 to 7 mm, the layer of the oxygen-delivering chemical adjacent to the inner shell end should have a thickness substantially exceeding the pellet size from two to fifteen times and that the oxygen-delivering chemical located on the section running from the distributing chamber to the layer of said matter adjacent to the inner shell end should have a thickness exceeding the pellet size substantially from ten to thirty times.

Such an embodiment of the regenerative canister is an optimum one since it provides for the afore-stated value of the respiratory resistance when use is made of the now available oxygen-delivering chemical featuring the pellet size of from 2 to 7 mm.

It is expedient that in the regenerative canister the air-permeable partitions defining the distributing chamber be axially traversable and spring-loaded with respect to each other.

Such an embodiment of the regenerative canister precludes any increase in the respiratory resistance due to disintegrated pellets of the oxygen-delivering chemical.

It is likewise advantageous that in the regenerative canister the heat-distributing elements be made as a multi-cell space screen or grate passing substantially along the entire length of the section running from the distributing chamber to the layer of the oxygen-delivering chemical adjacent to the inner shell end.

Such an embodiment of the regenerative canister provides for the afore-stated respiratory resistance value due to avoiding the agglutination or caking of the pellets of the oxygen-delivering chemical in the course of exothermic reactions.

It is reasonable that in the regenerative canister the heat-distributing element be made as at least two separate members arranged one above the other so that the cell walls of one of the members are offset with respect to the cell walls of the other member.

Such an embodiment of the regenerative canister adds to the operating reliability of the breathing apparatus.

It is also reasonable that in the regenerative canister the cells of the heat-distributing element should have the maximum size exceeding the pellet size from 2 to 5 times.

Such an embodiment of the regenerative canister is an optimum one to provide for reliable operation of the breathing apparatus and reduce the respiratory resistance.

It is likewise favourable that in the regenerative canister the heat-distributing element be made of aluminium and that its mass should equal substantially from 0.1 to 0.3 of the mass of the oxygen-delivering chemical located on the section running from the distributing chamber to the layer of the oxygen-delivering chemical adjacent to the inner shell end.

Such an embodiment of the regenerative canister is an optimum one since it provides for the aforesaid respiratory resistance and makes it possible to minimize the mass of the oxygen-breathing apparatus.

In what follows the invention will now be illustrated in a detailed description of some specific exemplary embodiments thereof to be had in conjunction with the accompanying drawings, wherein.

Figure 1:
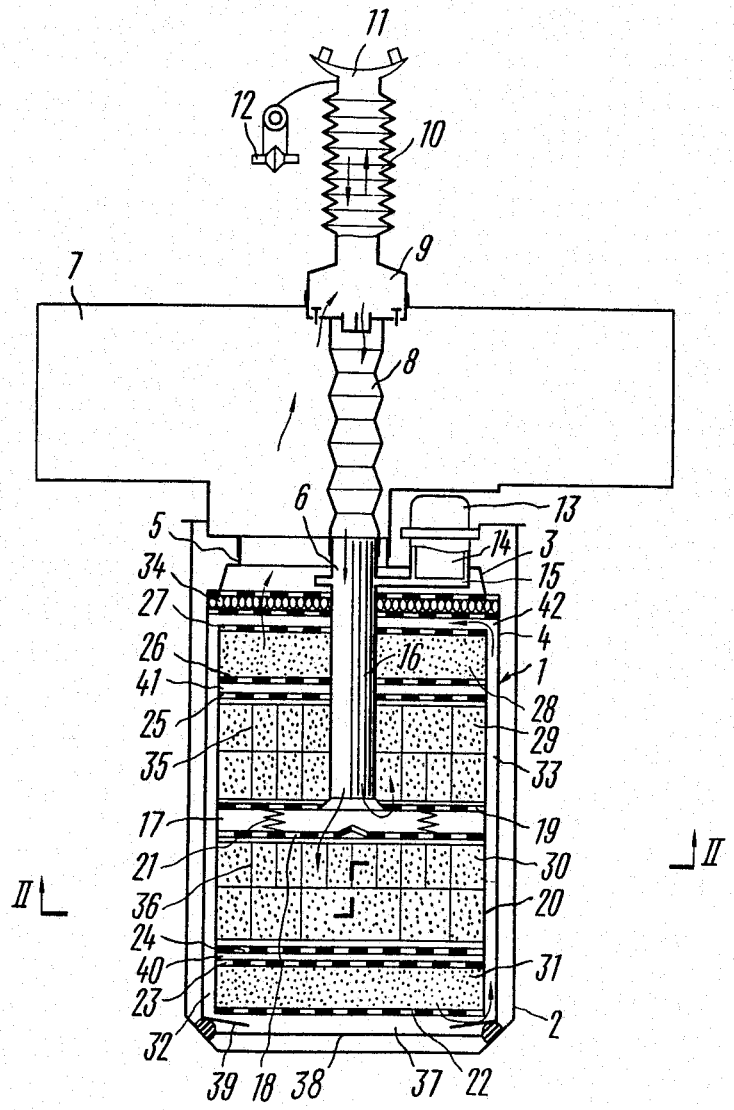
FIG. 1 is a vertical sectional view through a ready-for-use self-contained oxygen-breathing apparatus incorporating the regenerative canister made according to the invention.

The self-contained oxygen-breathing apparatus (FIG. 1) comprises a regenerative canister I secured in place inside a container 2. Provided on a cover 3 of an outer casing 4 of the cartridge 1 are an inhalation tube 5 and an exhalation tube 6 to which are attached a breathing bag 7 and an elastic breathing hose 8 made, e.g., as a rubber-textile tube reinforced with a coil spring. Secured on the breathing bag 7 are a valve box 9 with a breathing hose 10 which terminates in the face-piece, comprising a mouthpiece 11 and a nose clip 12. The set of the apparatus includes also smoke goggles not shown in the drawing.

The cover 3 of the casing 4 carries also a starting device 13 with a initiating briquette 14 and a box 15, said device communicating, via a central tube 16, with a distributing chamber 17 which is defined by perforated partitions 18 and 19 provided in the central portion of an inner shell 20 and capable of axial traversing. Springs 21 are positioned between the partitions 18 and 19. The oxygen-delivering chemical based on potassium superoxide $KO_2$ and accommodated in the shell 20, is divided by horizontal perforated partitions 22, 23, 24, 28, 19, 25, 26, 27 into different-depth layers or beds 28, 29, 30, 31. The partitions 22, 23, 24, 25, 26, 27 are rigidly locked in position inside the shell 20.

Figure 2:
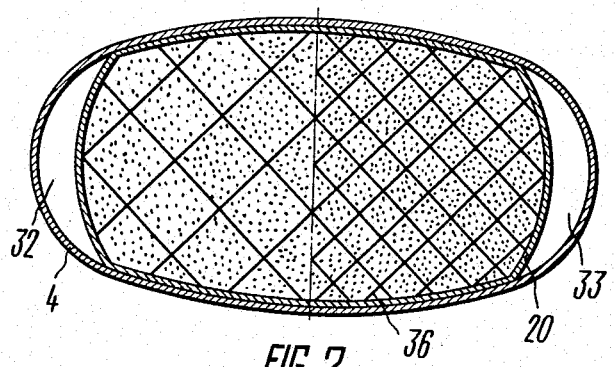
FIG. 2 is a section taken along the line II—II in FIG. 1.

The elliptical cross-section canister has crescent-shaped passages 32 and 33 (FIG. 2) defined by the inner shell 20 and the walls of the casing 4. A dust-catching filter 34 made of fibreglass is provided before the inhalation tube 5 (FIG. 1). The deeper layers of the oxygen-delivering chemical accommodate heat-distributing elements 35 and 36. A bottom collector space 37 of the canister casing 4 established by the bottom end partition 22 and a bottom-plate 38 of the casing accommodates segment-shaped dust catchers 39 positioned in front of the crescent-shaped passages 32 and 33. The layers 28, 29, 30, 31 of the oxygen-delivering chemical are accommodated inside the inner shell 20 somewhat apart from one another so as to define mixing chamber 40 and 41 therebetween. A top collector space 42 communicates with the bottom collector space 37 via the passages 32 and 33.

Figure 3:
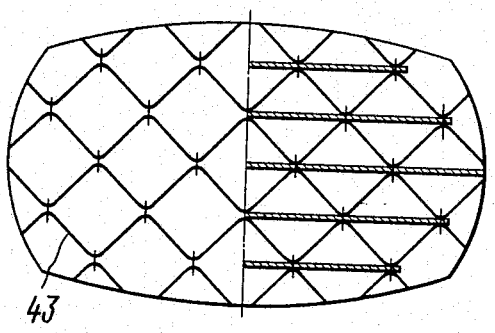
FIG. 3 is a schematic plan view of a heat-distributing element, according to the invention, made as corrugated metal strips.

Each of the heat-distributing elements 35 and 36 is made up of two separate multicell space screens or grates (FIG. 2), which are so arranged in the inner shell 20 that the cells of one screen should be offset with respect to the cells of the other screen. The screens may have differently shaped and sized cells. The screens with smaller cells are located in the inner shell 20 immediately at the distributing chamber 17. The simplest-to-manufacture is the screen of the heat-distributing element (FIG. 3) made of corrugated strips 43 rigidly coupled at the goffer apices. It is desirable that used for making such corrugated strips should be a metal featuring relatively high heat conductivity and low density, e.g. aluminium and its alloys.

Such an arrangement of the heat distributors prevents any ingress of $CO_2$ from the distributing chamber into the mixing chamber by virtue of the wall effect consisting in that the gas is free to pass along the walls of the heat-distributor cells through the gaps formed as a result of contact of the cell ruled surface with irregularly shaped pellets of the oxygen-delivering chemical. The size of the heat-distributor cells should exceed the size of the pellets from 2 to 5 times. When the size of a cell is below the lower limit the amount of free space between the pellets is increased since they cannot be packed snugly enough in the cell (the pellets being arranged in tandem), which renders a possibility of $CO_2$ ingress from the distributing chamber into the mixing chamber due to the wall effect more real. When the size of a cell is above the upper limit the mass of the oxygen-delivering chemical contained therein is so large that agglutination of the pellets is not excluded due to deteriorated heat withdrawal. This in turn results in an increased respiratory resistance.

The mass of the heat-distributing element should be within 0.1 to 0.3 of the mass of the matter in each layer. When the mass of the heat-distributing element is below the lower limit, agglutination of the pellets occurs and hence a higher respiratory resistance takes place due to insufficient heat capacity of the heat-distributing element. When the mass of the heat-distributing element is above the upper limit, this results not only in an unjustified increase in the mass of the breathing apparatus itself but also affects adversely its operation in the initial period of its operation following the operation of the starting device, since the element accumulates too much heat which is necessary for the chemical reduction reactions to initiate.

The dust catchers 39 (FIG. 1) intercept the coarse-grained fractions of the pelletized oxygen-delivering chemical, whereas the filter 34 entraps the fine-grained fractions. The fractions are carried away from the layers of the oxygen-delivering chemical by a stream of air after a man has started using the apparatus and are liable to produce irritating effect upon the respiratory organs.

The distributing chamber 17 contributes to uniform distribution of a stream of the exhaled air between the layers 29 and 30. Traversable mounting of the partitions 18 and 19 establishing the distributing chamber 17 prevents any increase in the respiratory resistance, since no disintegration of the pellets of the oxygen-delivering chemical may occur even under conditions of jolting and vibration while in transit. This is due to the fact that the pellets do not travel lengthwise the partitions, the walls of the heat-distributing elements and of the inner shell.

The starting device 13 comprises a spring-actuated striking mechanism and a glass ampoule containing an initiating fluid, e.g., sulphuric acid. When the ampoule is broken the initiating fluid gets onto the initiating briquette 14 made of the oxygen-delivering chemical. The preheated oxygen and water vapours produced by the initiating briquette cause the chemical reactions of the oxygen-delivering chemical in the canister to begin.

The regenerative canister of an oxygen-breathing apparatus operates as follows.

When opening the oxygen-breathing apparatus by removing its cover (not shown) the starting device 13 is made to operate, since it is associated with the cover by an elastic cord (e.g., a kapron one). Once the starting device 13 has operated it initiates decomposition of the briquette 14, which in turn, evolves preheated oxygen containing water vapours. Then the oxygen is supplied within 1 to 1.5 minutes along the passage of the box 15 and the tube 16 to the distributing chamber 17 and thence passes through the layers 29 and 30 of the oxygen-delivering chemical into the collector spaces 37 and 42. The aforesaid lapse of time is quite enough for the user to put the mouthpiece in his mouth, to set the nose clip 12 and put the goggles on. The amount of oxygen in the breathing bag is sufficient to provide normal breathing at the initial moment, that is until the heat and moisture liberated during decomposition of the briquette 14, as well as the moisture and $CO_2$ contained in the exhaled air passing along the hoses 8 and 10 promote the chemical reactions proceeding in the layers of the oxygen-delivering chemical.

The chemical reduction reactions proceeding in these layers are the exothermic ones. The heat-distributors 35 and 36 contribute to uniform heating of the entire bulk of the matter and withdraw heat to the walls of canister casing 4, which radiate the heat into the surrounding atmosphere.

Air from the collector space 42 passes through the filter 34 and the inhalation tube 5 to the breathing bag 7.

To the end of the protection time afforded by the breathing apparatus no agglutination of the pellets of the oxygen-delivering chemical occurs in the layers 29 and 30, while in the layers 28 and 31 the matter in a fused state, which contributes to active sorption of $CO_2$ from the exhaled air by the pellets despite the fact that a major part of the matter located in the layers 29 and 30 has largely been already spent. At the same time the respiratory resistance remains adequately low due to freedom from agglutination of the pellets of the oxygen-delivering chemical in the deeper layers and a low resistance offered by the fused matter contained in the thinner layer thereof.

The mixing chambers 40 and 41 contribute to better intermixing of the gas filament flows outcoming from the layers 29 and 30 of the oxygen-containing matter and to reducing the $CO_2$ content of the air passing into the layers 28 and 31, wherein further sorption of $CO_2$ by the oxygen-delivering chemical occurs.

The provision of the box 15 through which the starting device communicates, along the tube 16, with the distributing chamber 17 and the exhalation tube 6, makes it possible to retain the spent matter of the briquette 14 and thus to prevent it from getting onto the partition 18, which might result in a reduced cross-sectional area thereof.

The valve box 9 with the inhaling and exhaling valves provides for the circulatory air flow along the hose 8, the tube 16, the layers 28, 29, 30, 31 of the oxygen-delivering chemical and the breathing bag 7, whereas in the breathing hose 10 the air performs pendular motion.

The regenerative canister made according to the invention provides for reliable operation of a self-contained oxygen-breathing apparatus, since it prevents formation of any free, spaces between the inner casing wall and the layers of the oxygen-delivering chemical even under conditions of jolting and vibration while in transit. This is attained due to extraction of a maximum amount of oxygen from the matter, since the losses of the latter due to dust formation are minimized. No $CO_2$ ingress into the breathing bag occurs not only due to the provision of a free space between the layers of the oxygen-delivering chemical and the distributing chamber walls makes it possible to intermix the gas filament flows passing through the deeper layer of the oxygen-delivering chemical and to average the $CO_2$ content of the air flow before it is passed through the thinner layer of the oxygen-delivering chemical.

When the proposed breathing apparatus is applied in emergency situations, the physiological and hygienic respiratory conditions provided for a persons making use of the apparatus approximate the natural respiratory conditions without any breathing apparatus, which renders a positive emotional effect upon man and enables one to escape from hazardons areas at higher speeds and hence for a shorter period of time.

What we claim is:

1. A regenerative canister of a self-contained oxygen-breathing apparatus on chemically fixed oxygen, comprising:

an outer casing having ends;

an inhalation tube fluidically connected with said outer casing for supplying regenerated air to the respiratory organs;

an exhalation tube communicating with said outer casing for the exhaled air to supply thereinto;

an inner shell accommodated in said outer casing and communicating with said exhalation tube, said inner shell having air-permeable ends;

an oxygen-delivering chemical situated in said inner shell between the ends thereof;

a top and a bottom collector space defined between said ends of the inner shell and of the outer casing, a passageway defined between said inner shell and outer casing fluidically communicating said top and bottom collector spaces, and said inhalation tube communicating with said top collector space;

a filter provided in said inhalation tube;

a starting device adapted for initiating the evolution of oxygen by said oxygen-delivering chemical and located on said outer casing;

air-permeable transverse partitions installed substantially in the central portion of said inner shell and subdividing the interior thereof into two compartments; a distributing chamber formed by said transverse partitions and the walls of said inner shell, said chamber communicating with said starting device and said exhalation tube so as to direct the exhaled air from said distributing chamber to said ends of the inner shell through the bulk of said oxygen-delivering chemical;

at least two additional transverse partitions installed in each compartment of said inner shell so as to establish a mixing chamber therebetween and to divide said oxygen-delivering chemical into at least two layers as along the direction of air flow from said distributing chamber to the ends of said inner shell;

heat-distributing elements made of a heat-conducting material and located in each of the compartments of the inner shell in the bulk of said oxygen-delivering chemical on its section running from said distributing chamber to the layer of the oxygen-delivering chemical adjacent to the end of said inner shell for heat distribution and withdrawal from the oxygen-delivering chemical situated on said section.

2. A regenerative canister as claimed in claim 1, wherein said at least two additional partitions in each compartment of said inner shell are fastened close to its air-permeable end in such a manner that the layer of the oxygen-delivering chemical adjacent to said end has a thickness substantially equal to within 0.1 and 0.3 of the thickness of the oxygen-delivering chemical on the section spread from said distributing chamber to the layer of the oxygen-delivering chemical adjacent to the end of said inner shell.

3. Are generative canister as claimed in claim 2, wherein said inner shell is filled with an oxygen-delivering chemical in the form of pellets sized substantially from 2 to 7 mm, while the layer of the oxygen-delivering chemical adjacent to the end of said inner shell has a thickness substantially equalling from two to fifteen pellet sizes, and said oxygen-delivering chemical located on the section running from the distributing chamber to the layer of said matter adjacent to the end of said inner shell has a thickness exceeding the pellet size substantially from 10- to 30 fold.

4. A regenerative canister as claimed in claim 1, wherein said air-permeable partitions establishing said distributing chamber are axially traversable and spring-loaded with respect to each other.

5. A regenerative canister as claimed in claim 1, wherein said heat-distributing elements are made as a multicell space screen passing substantially along the entire length of the section running from said distributing chamber to the layer of the oxygen-delivering chemical adjacent to the inner shell end.

6. A regenerative canister as claimed in claim 5, wherein each of said heat-distributing elements is made as at least two separate members arranged one above the other so that the cell walls of one of said members are offset with respect to the cells walls of the other member.

7. A regenerative canister as claimed in claim 5, wherein said inner shell is filled with an oxygen-delivering chemical in the form of pellets, and the maximum size of the cells of each of the heat-distributing elements ranges from 2 to 5 pellet sizes.

8. A regenerative canister as claimed in claim 5, wherein said heat-distributing elements located in each compartment of the inner shell are made of aluminium and their mass equals substantially from 0.1 to 0.3 of the mass of the oxygen-delivering chemical located on the section running from the distributing chamber to the layer of the oxygen-delivering chemical adjacent to the inner shell end.

* * * * *